US008099908B2

(12) United States Patent
Brochu

(10) Patent No.: US 8,099,908 B2
(45) Date of Patent: Jan. 24, 2012

(54) ANTI-STREAK COVER FOR EAVESTROUGH

(76) Inventor: Guy Brochu, Québec (CA)

( * ) Notice: Subject to any disclaimer, the term of this patent is extended or adjusted under 35 U.S.C. 154(b) by 0 days.

(21) Appl. No.: 11/978,814

(22) Filed: Oct. 29, 2007

(65) Prior Publication Data

US 2009/0108144 A1 Apr. 30, 2009

(51) Int. Cl.
*E04D 13/064* (2006.01)

(52) U.S. Cl. ..... 52/11; 52/12; 52/15; 248/48.1

(58) Field of Classification Search ..... 52/11–16, 52/302.7, 58–62, 91.1, 91.3, 94–97; 248/48.1, 248/48.2; 210/474
See application file for complete search history.

(56) References Cited

U.S. PATENT DOCUMENTS

| | | | | |
|---|---|---|---|---|
| 4,084,272 | A * | 4/1978 | Laven | 4/510 |
| 4,483,025 | A * | 11/1984 | Meredith | 4/510 |
| 6,098,344 | A * | 8/2000 | Albracht | 52/12 |
| 6,944,992 | B2 * | 9/2005 | Brochu | 52/12 |
| 7,104,012 | B1 * | 9/2006 | Bayram | 52/12 |
| 7,143,549 | B2 * | 12/2006 | Brochu | 52/12 |
| 7,448,167 | B2 * | 11/2008 | Bachman | 52/12 |
| 2002/0166290 | A1 * | 11/2002 | Bergeron | 52/12 |
| 2003/0046876 | A1 * | 3/2003 | Higginbotham | 52/11 |
| 2004/0118052 | A1 * | 6/2004 | Brochu | 52/12 |
| 2008/0184629 | A1 * | 8/2008 | Kruk et al. | 52/11 |

FOREIGN PATENT DOCUMENTS

DE 29621400 U1 * 2/1997

* cited by examiner

*Primary Examiner* — Jeanette E. Chapman
(74) *Attorney, Agent, or Firm* — Eric Fincham

(57) ABSTRACT

An eavestrough cover designed to cover the upper front wall portions of a conventional eavestrough and which has a finish to minimize streaking or staining. The eavestrough cover snaps into position on the eavestrough.

22 Claims, 2 Drawing Sheets

ANTI-STREAK COVER FOR EAVESTROUGH

FIELD OF THE INVENTION

The present invention relates to eavestroughs or gutters, and more particularly, relates to improvements in a cover portion thereof.

BACKGROUND OF THE INVENTION

Eavestroughs are widely used to collect rainwater from the roof of a building and direct the same away from the building and in particular the foundation thereof. The eavestrough also protects the soil proximate to the building from erosion by the rainwater dripping from the roof.

A common problem with eavestroughs has been the accumulation of debris therein. Such debris can include leaves, twigs, and the like. In order to obviate the problem, it is known in the art to provide a shield or cover which will allow the passage of rainwater from the roof to the eavestrough while protecting the same from extraneous foreign matter such as the aforementioned leaves and twigs.

A number of different approaches have been taken as to the design of the shield or cover and the attachment of the shield or cover to the eavestrough. Other approaches have also been taken to eliminate the problem of debris within the eavestrough. Thus, it has been proposed that the eavestrough be rotatably mounted such that they may be emptied at desired intervals. A further still further approach is one wherein a cover has an outer edge which curls downwardly and the water follows a curved portion due to the surface tension and thereafter cascades into the eavestrough. Theoretically, any leaves or other debris would not enter as they would continue to fall to the ground. However, when large volumes of water are encountered, the surface tension is generally insufficient to cause all the rainwater to flow into the eavestrough.

When utilizing the eavestrough cover, various parameters have to be taken into account. Thus, the size and number of the apertures in the membrane must ensure that there are sufficient openings to permit the water to enter the eavestrough even during heavy downpours. Also, it is important to take into account the attachment of the cover or membrane to the eavestrough. The attachment must be both secure and permit easy installation.

A still further problem which is encountered with the eavestrough is the staining of the front wall thereof. Particularly when the paint is of a poor quality, the rain water with surrounding contaminants can lead to a stain being formed on the front over a period of years. Naturally this is not aesthetically pleasing.

SUMMARY OF THE INVENTION

It is an object of the present invention to provide an eavestrough cover or membrane which can be easily secured to the eavestrough.

It is a further object of the present invention to provide an eavestrough cover or membrane which will also prevent the staining of the front wall of the eavestrough.

According to one aspect of the present invention, there is provided an eavestrough cover for use with an eavestrough having an eavestrough rear wall, an eavestrough bottom wall, an eavestrough front wall wherein the eavestrough front wall has a substantially vertical segment at an upper end thereof, an eavestrough top wall extending inwardly from the substantially vertical segment, and a flange extending downwardly and inwardly towards the substantially vertical segment, the eavestrough cover comprising a central planar portion, first and second side structures, the central planar portion being apertured, the first side structure being designed to cover the eavestrough top wall and the eavestrough vertical segment, the first side structure being designed to lock with the eavestrough to maintain the eavestrough cover in position, and the second side structure being designed to abut the eavestrough rear wall.

According to a further aspect of the present invention, there is provided, in combination, an eavestrough and an eavestrough cover for use therewith, the eavestrough comprising an eavestrough cover for use with an eavestrough having an eavestrough rear wall, an eavestrough bottom wall, an eavestrough front wall wherein the eavestrough front wall has a substantially vertical segment at an upper end thereof, an eavestrough top wall extending inwardly from the substantially vertical segment, and a flange extending downwardly and inwardly towards the substantially vertical segment, the eavestrough cover comprising a central planar portion, first and second side structures, the central planar portion being apertured, the first side structure covering the eavestrough top wall and the eavestrough vertical segment, the first side structure locking with the eavestrough to maintain the eavestrough cover in position, and the second side structure abutting the eavestrough rear wall.

The eavestrough cover of the present invention is for use with a standard eavestrough which has the eavestrough rear wall, an eavestrough bottom wall, an eavestrough front wall and wherein the eavestrough front wall has a substantially vertical segment at an upper end and with a flange extending downwardly and inwardly from a top wall portion. The eavestrough cover is designed to cover the top wall of the eavestrough itself and to prevent streaking which can be unsightly. The design of the eavestrough cover minimizes the amount of rain dripping down the front of the eavestrough and as well, the cover may be designed to be of a finish which is highly resistant to streaking or staining.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
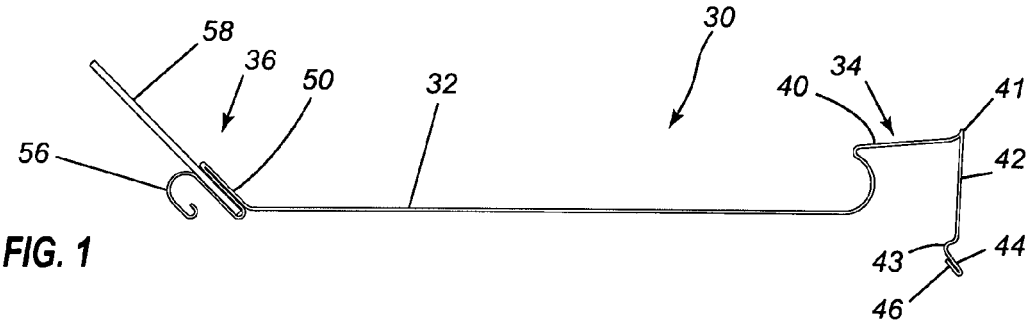
FIG. 1 is a side elevational view of a eavestrough cover according to one embodiment of the present invention.
Figure 2:
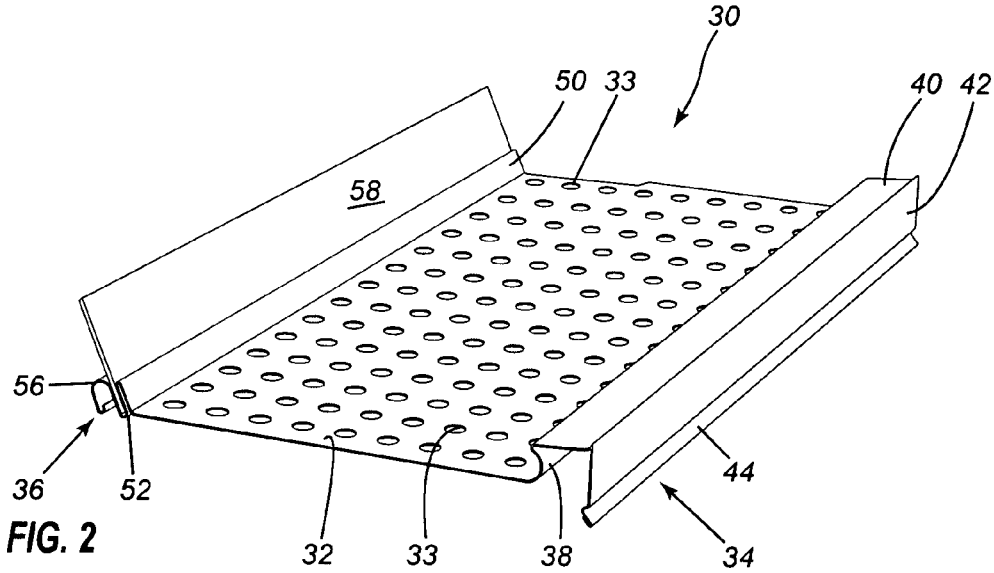
FIG. 2 is a perspective view thereof.
Figure 3:
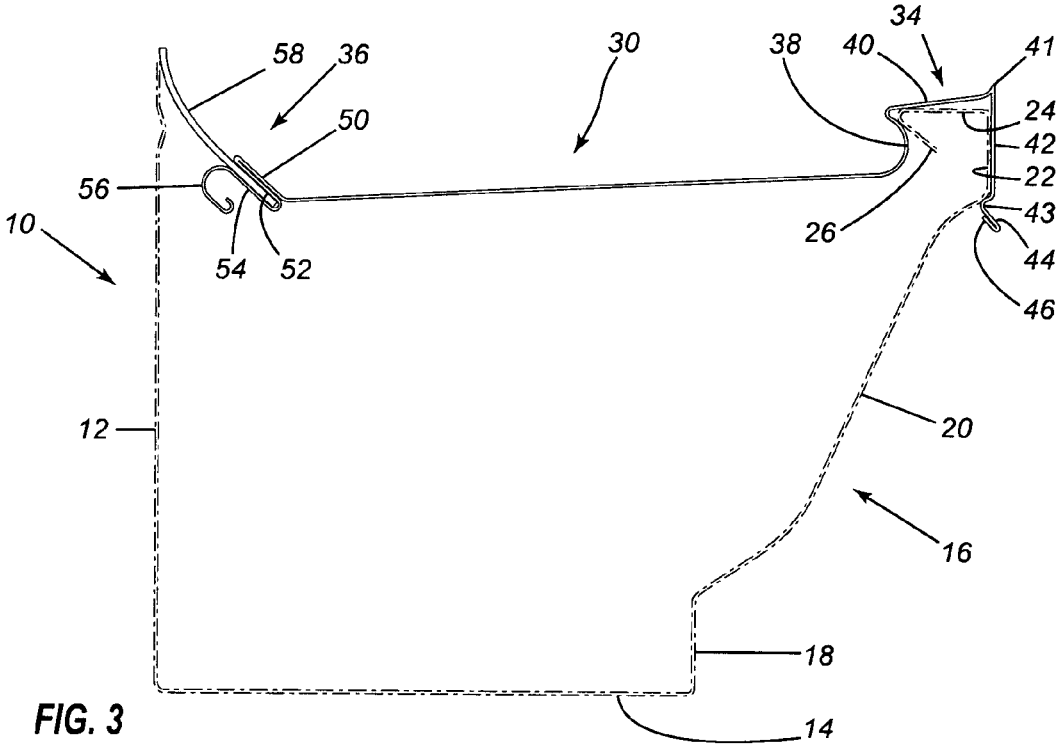
FIG. 3 is an end elevational view showing the cover in place on a eavestrough.

Referring to the drawings in greater detail and by reference numerals thereto, there is illustrated in FIG. 3 an eavestrough (as shown in dot dash lines) and which eavestrough is generally designated by reference numeral 10.

Eavestrough 10 has an eavestrough back wall 12, an eavestrough bottom wall 14, and eavestrough front wall 16. Eavestrough front wall 16 is comprised of three segments; a lower vertical segment 17, and intermediate arcuate segment 20 and an upper vertical segment 22. At the top end of upper segment 22, eavestrough 10 has an eavestrough top wall 24 and which terminates in a downwardly and inwardly extending flange 26. The design and configuration of eavestrough 10 is one that is well known in the art and widely available.

The eavestrough cover of the present invention is generally designated by reference numeral 30 and includes a substantially planar central portion 32 having a plurality of apertures 33 formed therein. Apertures 33 permit the drainage of rainwater into eavestrough 10.

On either side of central planar portion 32 there is provided a first side portion generally designated by reference numeral 34 and a second side portion generally designated by reference numeral 36.

Referring initially to first side portion 34, as will be seen in FIG. 3, central planar portion 32 merges with a C shaped segment 38 which in turn, merges with a cover top wall 40. As will be seen, cover top wall 40 angles diagonally upwardly so as to be partially spaced from eavestrough top wall 24 at the outer portion thereof. Cover top wall 40 terminates in an upwardly extending peak 41. Subsequently, there is a cover front wall 42. At its lower end, cover front wall 42 extends inwardly in a C shaped arcuate configuration as shown by reference numeral 43. There is provided a diagonally outwardly extending flange 44 with an end segment 46 being substantially parallel thereto.

At second side 36, central planar portion 32 extends upwardly in a diagonally and upwardly extending segment 50. A second segment 52 lies parallel to segment 50 and with a second upwardly extending segment 54 defines therebetween a channel which is designed to receive a sealing strip 58 and retain sealing strip 58 in position. A U-shaped segment 56 is utilized to finish the end of the cover.

In use, and this may be seen from FIG. 3, arcuate segments 38 and 43 act to retain cover member 30 in position on eavestrough 10. Naturally, if desired, other fastening means may also be utilized.

The arrangement of cover top wall 40 is such that any rain falling thereon is directed back towards the planar central portion 32. The termination in a peak portion 41 assists in achieving this.

Eavestrough cover front wall 42 may be provided with any desired decorative effect.

Figure 4:
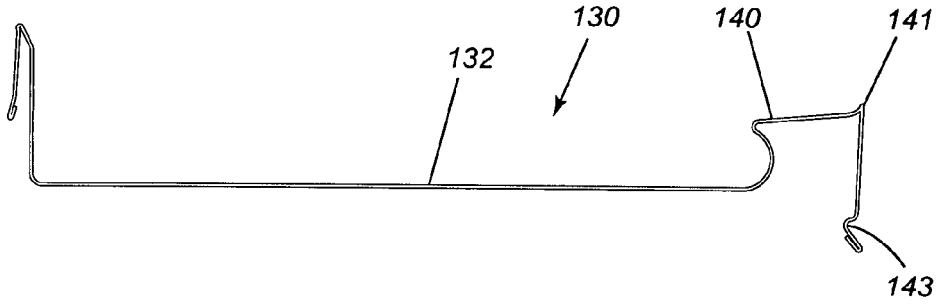
FIG. 4 is an end elevational view of a further embodiment of an eavestrough cover according to the present invention.
Figure 5:
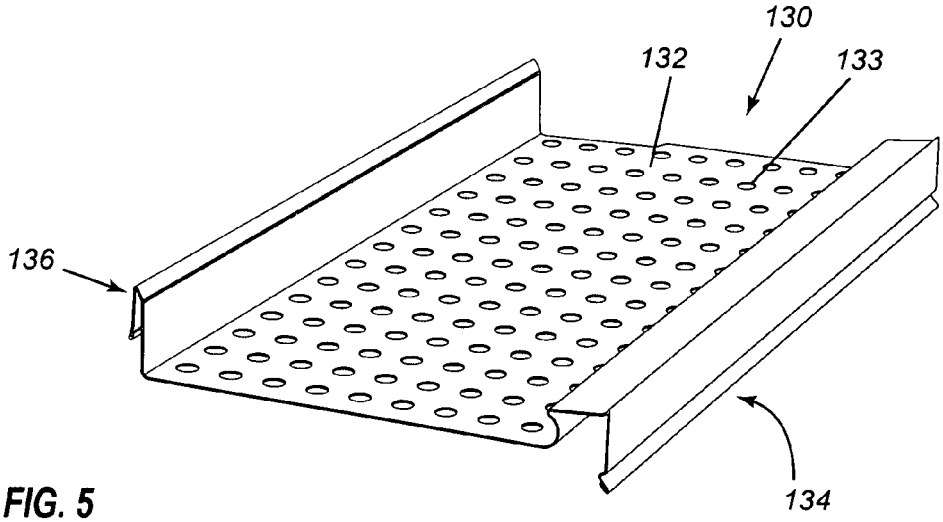
FIG. 5 is a perspective view thereof.
Figure 6:
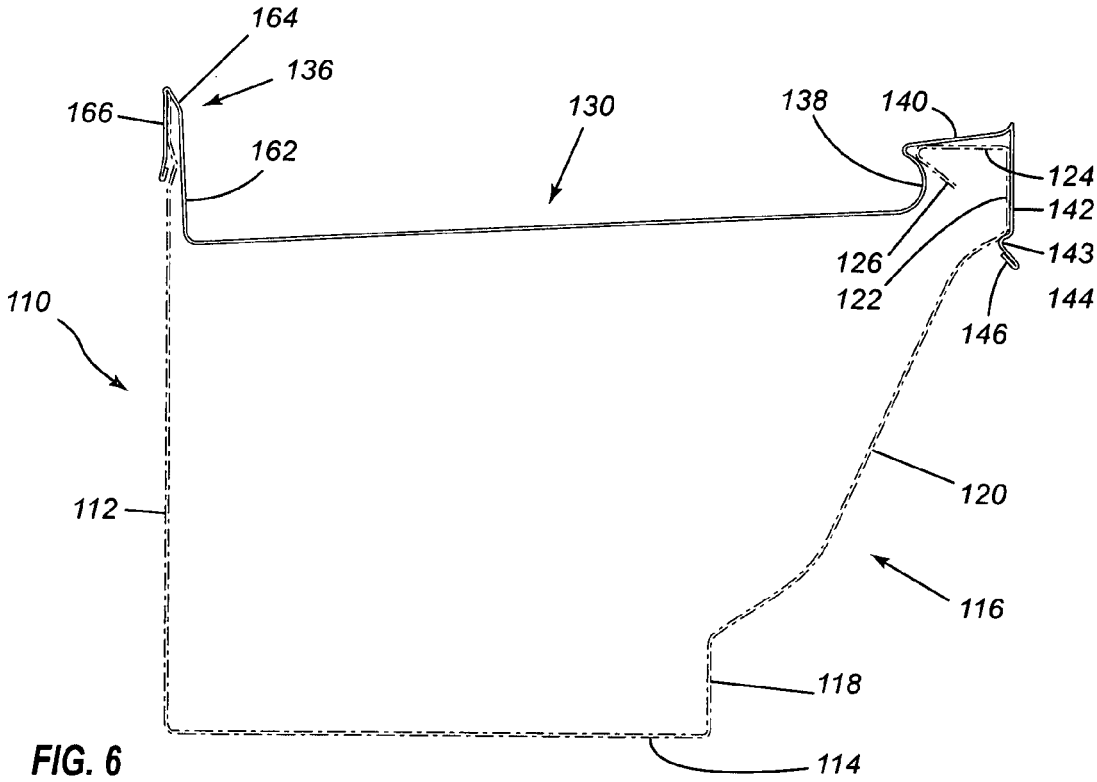
FIG. 6 is an end elevational view illustrating the eavestrough cover in place on an eavestrough.

Reference will now be had to the embodiment of FIGS. 4 to 6. In this embodiment, similar reference numerals in the 100's are utilized for similar components.

As may be seen in FIG. 6, an eavestrough 110 has an eavestrough wall 112, an eavestrough bottom wall 114 and an eavestrough front wall generally designated by reference numeral 116. Eavestrough front wall 116, as in the previously described embodiment includes vertical lower segment 18, intermediate arcuate segment 120 and vertical top segment 122.

The eavestrough cover 130 is similar to that previously described except with respect to second side 136. As may be seen in FIG. 3, second side 136 includes an essentially vertical extending back wall 162 which merges with a diagonally extending segment 164. A downwardly extending segment 166, along with vertical segment 162, encases the upper portion of eavestrough rear wall 112.

In this embodiment, the eavestrough and cover are preferably secured by means of a screw extending through walls 162, 166 and 112.

It will be understood that the above described embodiment is for purposes of illustration only and that changes and modifications may be made thereto without departing from the spirit and scope of the invention.

I claim:

1. An eavestrough cover for use with an eavestrough having an eavestrough rear wall, an eavestrough bottom wall, an eavestrough front wall wherein said eavestrough front wall has a substantially vertical segment at an upper end thereof, an eavestrough top wall extending inwardly from said substantially vertical segment, and a flange extending downwardly and inwardly towards said substantially vertical segment, said eavestrough cover comprising a central planar portion, first and second side structures, said central planar portion being apertured;

said first side structure being designed to cover said eavestrough top wall and said eavestrough vertical segment, said first side structure being designed to lock with said eavestrough to maintain said eavestrough cover in position , said first side structure including a cover top wall overlying said eavestrough top wall, said cover top wall sloping downwardly towards said central planar portion, a cover front wall overlying said vertical segment;

said second side structure being designed to abut said eavestrough rear wall; and said cover top wall merging with an arcuate inwardly extending segment adjacent said central planar portion such that said arcuate section abuts said flange of said eavestrough.

2. The eavestrough cover of claim 1 wherein said entire central planar portion slopes downwardly from said first side structure towards said second side structure.

3. The eavestrough cover of claim 1 wherein said cover top wall and said cover front wall meet to have a peaked portion, said eavestrough cover being retained in position solely by said first side structure.

4. The eavestrough cover of claim 3 further including an arcuate inwardly extending concave section at a bottom of said cover front wall.

5. The eavestrough cover of claim 4 wherein said inwardly extending arcuate portion terminates in a flange extending downwardly and outwardly.

6. The eavestrough cover of claim 5 wherein said flange is folded back on itself to have a double thickness.

7. The eavestrough. cover of claim 1 wherein said second side structure includes a sealing member, retained by said eavestrough cover, said sealing member being flexible and seating against said eavestrough rear wall.

8. The eavestrough cover of claim 1 wherein said second side structure comprises an inverted U-shaped configuration adapted to fit over the top of said eavestrough rear wall on both sides thereof.

9. In combination, an eavestrough and an eavestrough cover for use therewith, said eavestrough comprising an eavestrough cover for use with an eavestrough having an eavestrough rear wall, an eavestrough bottom wall, an eavestrough front wall wherein said eavestrough front wall has a substantially vertical segment at an upper end thereof, an eavestrough top wall extending inwardly from said substantially vertical segment, and a flange extending downwardly and inwardly towards said substantially vertical segment, said eavestrough cover comprising a central planar portion, first and second side structures, said central planar portion being apertured;

said first side structure covering said eavestrough top wall and said eavestrough vertical segment, said first side structure locking with said eavestrough to maintain said eavestrough cover in position, said first side structure including a cover top wall overlying said eavestrough top wall, said cover top wall sloping downwardly towards said, central planar portion, a cover side wall overlying said vertical segment;

said second side structure abutting said eavestrough rear wall; and said cover top wall with an arcuate inwardly extending segment adjacent said central planar portion such that said arcuate section abuts said of said eavestrough.

10. The combination of claim 9 wherein said entire central planar portion slopes downwardly from said first structure towards said second side structure.

11. The combination of claim 9 wherein said cover top wall and said cover front wall meet to have a peaked portion, said eavestrough cover being retained in position solely by said first side structure.

12. The combination of claim 11 further including an arcuate inwardly extending concave section at a bottom of said cover front wall.

13. The combination of claim 12 wherein said inwardly extending arcuate portion terminates in a flange extending downwardly and outwardly.

14. The combination of claim 13 wherein said flange is folded back on itself to have a double thickness.

15. The combination of claim 9 wherein said second side structure includes a sealing member retained by said eavestrough cover, said sealing member being flexible and seating against said eavestrough rear wall.

16. The combination of claim 9 wherein said second side structure comprises an inverted U-shaped configuration adapted to fit over the top of said eavestrough mar wall on both sides thereof.

17. An eavestrough cover for use with an eavestrough having an eavestrough rear wall, an eavestrough bottom wall, an eavestrough front wall wherein said eavestrough front wall has a substantially vertical segment at an upper end thereof, an eavestrough top wall extending inwardly from said substantially vertical segment, and a flange extending downwardly and inwardly towards said substantially vertical segment, said eavestrough cover comprising a central planar portion, first and second side structures, said central planar portion being apertured;

said first side structure being designed to cover said eavestrough top wall and said eavestrough vertical segment, said cover top wall merging with an arcuate inwardly extending segment adjacent said central planar portion such that said arcuate section abuts said flange of said eavestrough;

said second side structure being designed to abut said eavestrough rear wall; and an arcuate inwardly extending concave section located at a bottom of said cover wall, said, inwardly extending arcuate portion terminates in a flange extending downwardly and outwardly.

18. The eavestrough cover of claim 17 wherein said flange is folded back on itself to have a double thickness.

19. In combination, an eavestrough and an eavestrough cover for use therewith, said eavestrough comprising an eavestrough cover for use with an eavestrough having an eavestrough rear wall, an eavestrough bottom wall, an eavestrough front wall wherein said eavestrough front wall has a substantially vertical segment at an upper end thereof, an eavestrough top wall extending inwardly from said substantially vertical segment, and a flange extending downwardly and inwardly towards said substantially vertical segment, said eavestrough cover comprising a central planar portion, first and second side structures, said central planar portion being apertured;

said first side structure covering said eavestrough top wall and said eavestrough vertical segment, said cover top wall merging with an arcuate inwardly extending segment adjacent said central planar portion such that said arcuate section abuts said flange of said eavestrough; and said second side structure abutting said eavestrough rear wall.

20. The combination of claim 19 further, including an arcuate inwardly extending concave section at a bottom of said cover front wall.

21. The combination of claim 20 wherein said inwardly extending arcuate portion terminates in a flange extending downwardly and outwardly.

22. The combination of claim 21 wherein said flange is folded back on itself to have a double thickness.

* * * * *